US011519246B2

(12) United States Patent
Grove et al.

(10) Patent No.: US 11,519,246 B2
(45) Date of Patent: Dec. 6, 2022

(54) MOMENTUM TRAP

(71) Applicant: Halliburton Energy Services, Inc., Houston, TX (US)

(72) Inventors: Brenden Michael Grove, Mansfield, TX (US); Jason Metzger, Joshua, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/590,652

(22) Filed: Oct. 2, 2019

(65) Prior Publication Data

US 2020/0199981 A1 Jun. 25, 2020

(51) Int. Cl.
*E21B 43/117* (2006.01)

(52) U.S. Cl.
CPC ..... *E21B 43/117* (2013.01)

(58) Field of Classification Search
CPC ..... E21B 43/117
See application file for complete search history.

(56) References Cited

U.S. PATENT DOCUMENTS 2,818,808 A * 1/1958 Dill ..... E21B 43/117 175/4.6
2,833,213 A * 5/1958 Udry ..... E21B 43/117 175/4.6
4,326,462 A 4/1982 Garcia et al.
6,386,109 B1 5/2002 Brooks et al.
7,770,662 B2 8/2010 Harvey et al.
2003/0150646 A1 8/2003 Brooks et al.
2005/0194181 A1* 9/2005 Barker ..... E21B 43/119 175/4.55
2007/0095572 A1 5/2007 Harvey et al.
2014/0182474 A1* 7/2014 Dunaway ..... B22F 5/00 102/374
2014/0262503 A1* 9/2014 Rodgers ..... E21B 43/116 175/2
2017/0145798 A1 5/2017 Robey et al.
2017/0159420 A1 6/2017 Tolman et al.
2018/0209251 A1 7/2018 Robey et al.

* cited by examiner

*Primary Examiner* — D. Andrews
(74) *Attorney, Agent, or Firm* — John Wustenberg; Parker Justiss, P.C.

(57) ABSTRACT

The present disclosure provides an embodiment of a perforating gun assembly for use in a wellbore. The perforating gun assembly, in one example includes a carrier gun body. The perforating gun assembly, in this example, further includes a plurality of shaped charges supported within the carrier gun body, wherein each shaped charge may include a case exterior, the case exterior including an outer surface, and an inner surface forming a cavity, a liner located within the cavity, and explosive material located within a gap between the inner surface of the case exterior and the liner. The perforating gun assembly, in this example, may further include one or more momentum traps positioned between one or more adjacent shaped charges.

25 Claims, 5 Drawing Sheets

MOMENTUM TRAP

CROSS-REFERENCE TO RELATED APPLICATION

This application claims priority to International Application Serial No. PCT/US2018/067222, filed on Dec. 21, 2018, and entitled "MOMENTUM TRAP," is commonly assigned with this application and incorporated herein by reference in its entirety.

BACKGROUND

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more perforating guns are loaded with shaped charges that are connected with a detonator via a detonation cord. The perforating guns are then connected within a tool string that is lowered into the cased wellbore at the end of a tubing string, wireline, slick line, coil tubing or other conveyance. Once the perforating guns are properly positioned in the wellbore such that the shaped charges are adjacent to the formation to be perforated, the shaped charges may be detonated, thereby creating the desired openings.

The performance of the well is dependent on the ability to easily extract hydrocarbons from the surrounding formation. Thus, improvements are needed in the art to more easily extract hydrocarbons from the surrounding formation.

BRIEF DESCRIPTION

Reference is now made to the following descriptions taken in conjunction with the accompanying drawings, in which.

DETAILED DESCRIPTION

Figure 1:
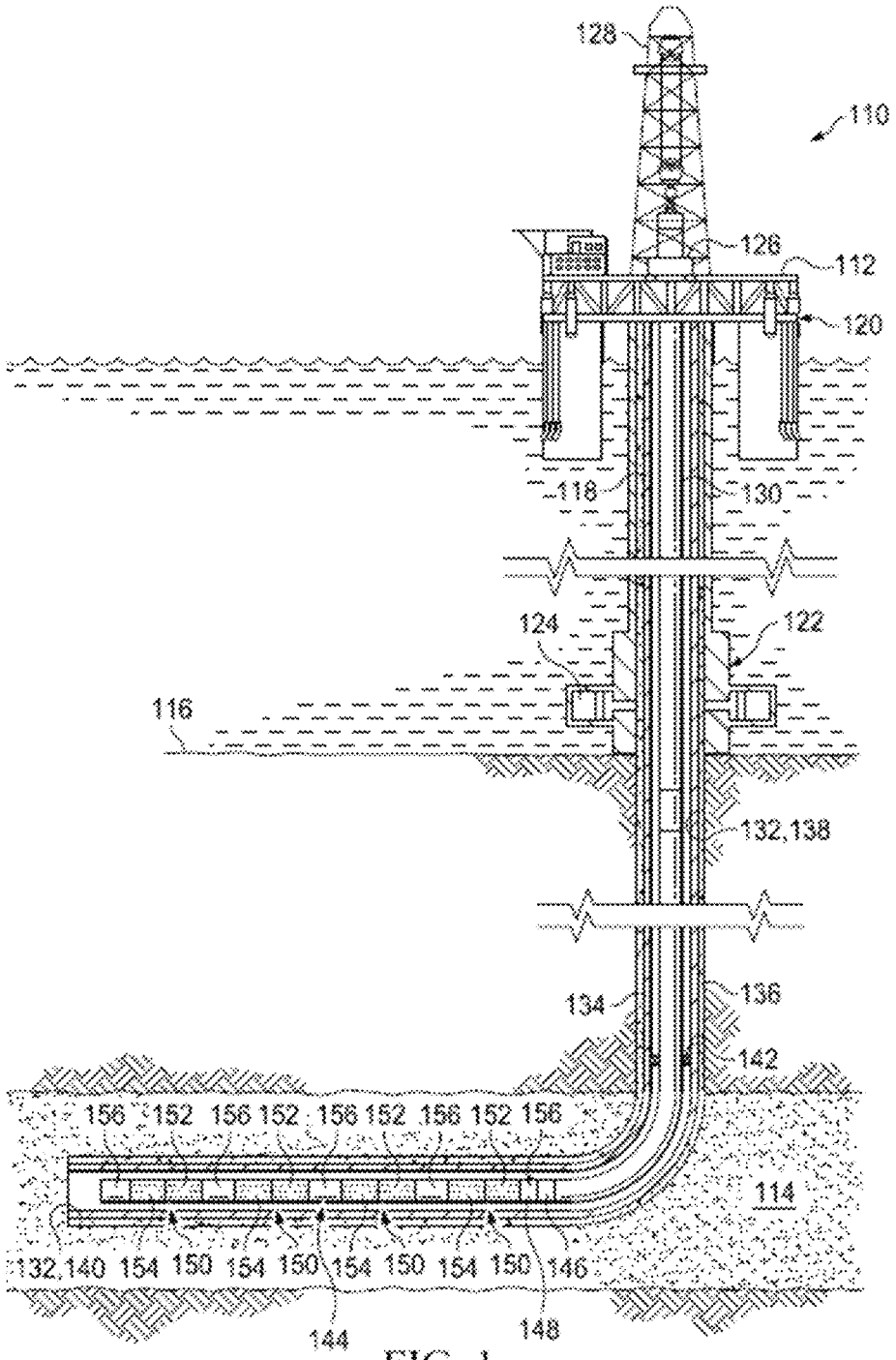
FIG. 1 is a schematic illustration of a well system including a plurality of perforating gun assemblies of the present disclosure operating in a subterranean formation.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Referring initially to FIG. 1, schematically illustrated is a well system 100 including a plurality of perforating gun assemblies of the present disclosure operating in a subterranean formation (e.g., from an offshore oil and gas platform). A semi-submersible platform 112 is centered over a submerged oil and gas formation 114 located below sea floor 116. A subsea conduit 118 extends from deck 120 of platform 112 to wellhead installation 122 including subsea blow-out preventers 124. Platform 112 has a hoisting apparatus 126 and a derrick 128 for raising and lowering pipe strings such as work string 130. As used herein, work string encompasses any conveyance for downhole use, including drill strings, completion strings, evaluation strings, other tubular members, wireline systems, and the like.

A wellbore 132 extends through the various earth strata including formation 114. In the embodiment of FIG. 1, a casing 134 is cemented within wellbore 132 by cement 136. Work string 130 includes various tools such as a plurality of perforating gun assemblies of the present disclosure. When it is desired to perforate formation 114, work string 130 is lowered through casing 134 until the perforating guns are properly positioned relative to formation 114. Thereafter, the shaped charges within the string of perforating guns may be sequentially fired, either in an uphole to downhole or a downhole to uphole direction. Upon detonation, the liners of the shaped charges form jets that create a spaced series of perforations extending outwardly through casing 134, cement 136 and into formation 114, thereby allowing fluid communication between formation 114 and wellbore 132. In accordance with one embodiment of the disclosure, a momentum trap may be disposed between one or more adjacent charges of the perforating gun assembly. Specifics of the momentum trap will be discussed in greater detail below.

In the illustrated embodiment, wellbore 132 has an initial, generally vertical portion 138 and a lower, generally deviated portion 140 which is illustrated as being horizontal. It should be noted, however, by those skilled in the art that the perforating gun assemblies of the present disclosure are equally well-suited for use in other well configurations including, but not limited to, inclined wells, wells with restrictions, non-deviated wells and the like.

In the embodiment of FIG. 1, work string 130 includes a retrievable packer 142 which may be sealingly engaged with casing 134 in a vertical portion 138 of wellbore 132. At the lower end of work string is a gun string, generally designated 144. In the illustrated embodiment, gun string 144 has at its upper or near end a ported nipple 146 below which is a time domain firer 148. Time domain firer 148 is disposed at the upper end of a tandem gun set 150 including first and second guns 152 and 154. In the illustrated embodiment, a plurality of such gun sets 150, each including a first gun 152 and a second gun 154 are utilized. Positioned between each gun set 150 in the embodiment of FIG. 1 is a blank pipe section 156. Blank pipe sections 156 may be used to control and optimize the pressure conditions in wellbore 132 immediately after detonation of the shaped charges. While tandem gun sets 150 have been described with blank pipe sections 156 there between, it should be understood by those skilled in the art that any arrangement of perforating guns may be utilized in conjunction with the present disclosure including both more or less sections of blank pipe as well as no sections of blank pipe, without departing from the principles of the present disclosure.

Figure 2:
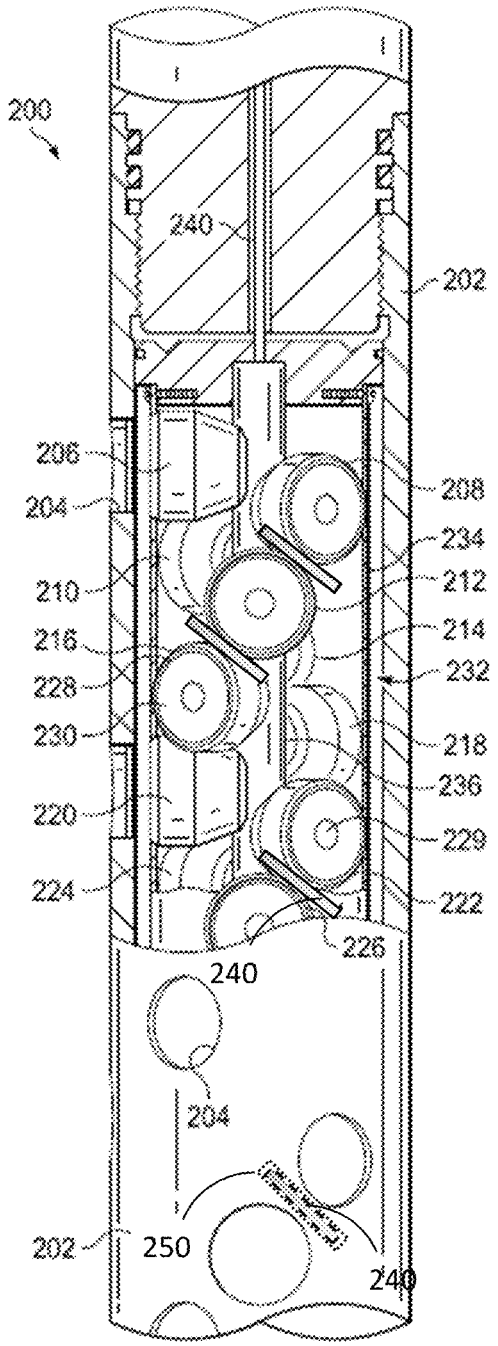
FIG. 2 is a partial cut away view of a perforating gun assembly of the present disclosure.

Referring now to FIG. 2, therein is depicted a perforating gun assembly of the present disclosure that is generally designated 200. In one embodiment, the perforating gun assembly 200 forms at least a portion of the gun sets 150 illustrated in FIG. 1. Perforating gun assembly 200 includes a carrier gun body 202, in one embodiment made of a cylindrical sleeve having a plurality of radially reduced areas depicted as scallops or recesses 204. Radially aligned with each of the recesses 204 is a respective one of a plurality of shaped charges, only eleven of which, shaped charges 206-226, are visible in FIG. 2.

Each of the shaped charges, such as shaped charge 216 includes an outer housing, such as case exterior 228, an inner housing, such as case interior 229 and a liner 230. Furthermore, disposed between each case exterior 228, case interior 229 and liner 230 is a quantity of explosive material.

The shaped charges 206-226, in the embodiment shown, are retained within carrier gun body 202 by a charge holder 232 which includes an outer charge holder sleeve 234 and an inner charge holder sleeve 236. In this configuration, outer tube 234 supports the discharge ends of the shaped charges, while inner tube 236 supports the initiation ends of the shaped charges. Disposed within inner tube 236 is a detonation cord 240, which is used to detonate the shaped charges. In the illustrated embodiment, the initiation ends of the shaped charges extend across the central longitudinal axis of perforating gun assembly 200 allowing detonation cord 240 to connect to the high explosive within the shaped charges through an aperture defined at the apex of the housings of the shaped charges.

In the embodiment of FIG. 2, each of the shaped charges 206-226 is longitudinally and radially aligned with one of the recesses 204 in carrier gun body 202 when perforating gun assembly 200 is fully assembled. In the illustrated embodiment, the shaped charges are arranged in a spiral pattern such that each of the shaped charge is disposed on its own level or height and is to be individually detonated so that only one shaped charge is fired at a time. It should be understood by those skilled in the art, however, that alternate arrangements of shaped charges may be used, including cluster type designs wherein more than one shaped charge is at the same level and is detonated at the same time, without departing from the principles of the present disclosure.

In accordance with the disclosure, one or more momentum traps 240 may be positioned between one or more of the adjacent shaped charges 206-226. In the illustrated embodiment, the charge holder 232 may have a plurality of openings 250 (e.g., illustrated with dotted lines to depict the openings 250 are enclosed by the carrier gun body 202) in the exterior thereof for receiving one or more momentum traps 240 therein. In the illustrated embodiment, the openings 250 were laser or die cut within the charge holder 232 at a precise location as to place the momentum traps 240 between the one or more adjacent shaped charges 206-226. Other methods for creating the openings 250 are within the scope of the disclosure. In fact, certain embodiments exist wherein no openings 250 are used, or alternatively wherein the openings 250 are placed within the carrier body 202, among other places.

As will be discussed herein, in some embodiments, the momentum traps 240 may be positioned between two adjacent shaped charges such as, e.g. shaped charges 208 and 212, wherein the shaped charge 208 is fully isolated from the shaped charge 212. Fully isolated, as used herein, means that there is no part of shaped charge 208 that is exposed to shaped charge 212. In some embodiments, fully isolated may be achieved by positioning the momentum trap 240 such that the momentum trap 240 extends at least to a top end (or radially outward end) of shaped charges 208 and 212 and extend at least to a bottom (or radially inward) end of shaped charges 208 and 212, such that no portion of one is exposed to the other. In other embodiments, the momentum trap 240 may extend beyond the top and bottom ends of shaped charges 208 and 212. In other embodiments, however, adjacent shaped charges may only be partially isolated.

Figure 3:
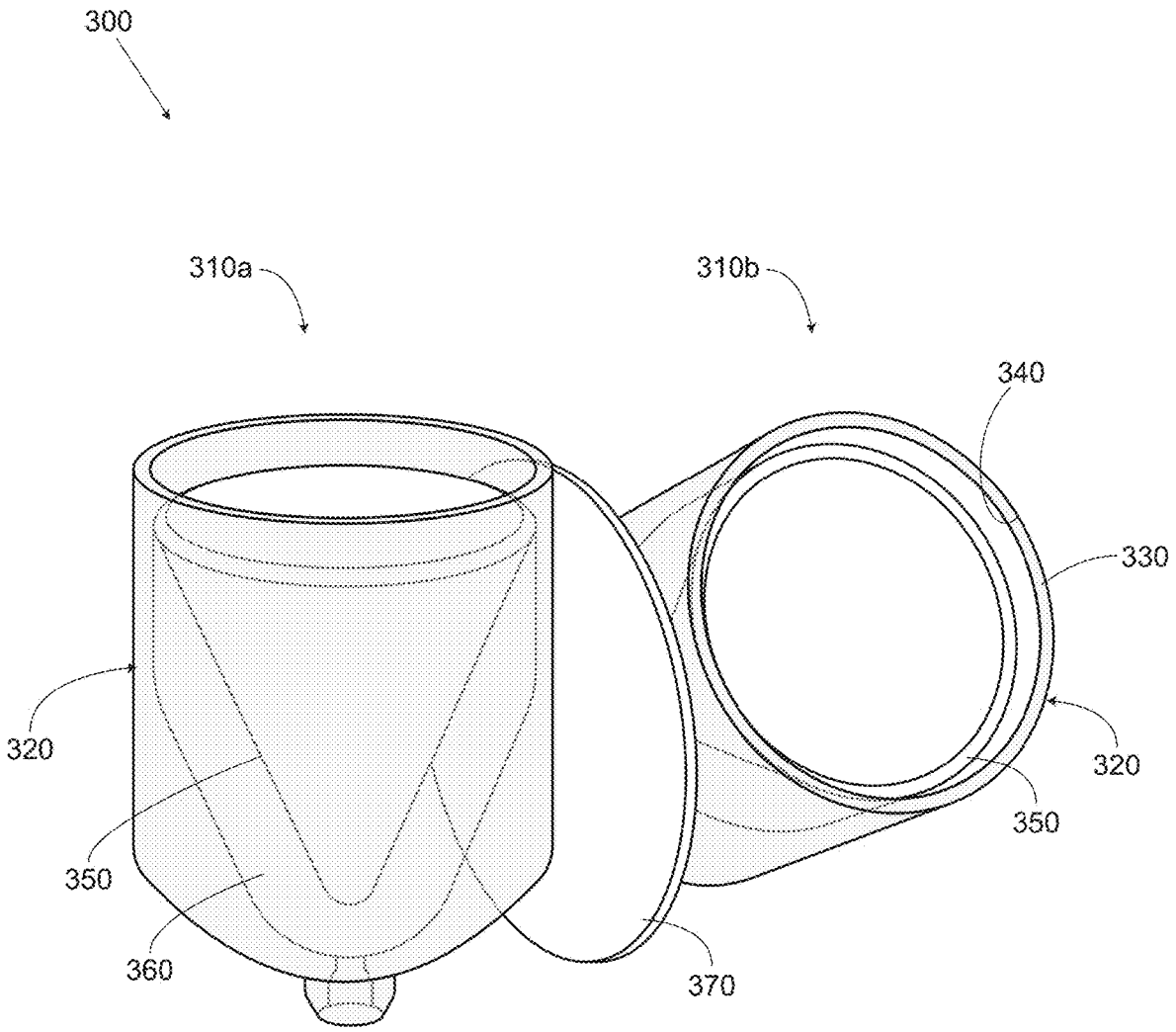
FIG. 3 is an alternative embodiment of a pair of shaped charges in accordance with the disclosure.

Referring now to FIG. 3, therein is depicted one embodiment of a shaped charge system 300 which may be used within a perforating gun assembly such as perforating gun assembly 200. The shaped charge system 300 may include a plurality of shaped charges 310*a* and 310*b*, which may be supported within the carrier gun body 202. In one embodiment, the shaped charges 310*a* and 310*b* may be positioned adjacent each other, and adjacent additional shaped charges. In the embodiment shown, the shaped charges 310*a* and 310*b* are positioned such that they are offset from each other at an angle. In some embodiments, the offset angle may be about 60 degrees, but those skilled in the art understand that the shaped charges 310*a*, 310*b* may be positioned in various arrangements and offset at various angles. Each shaped charge 310*a*, 310*b* may include a case exterior 320, the case exterior including an outer surface 330, and an inner surface 340 forming a cavity. A liner 350 may be located within the cavity and explosive material 360 may be located within a gap between the inner surface 340 of the case exterior 320 and the liner 350. A momentum trap 370 may be positioned between one or more adjacent shaped charges, such as shaped charges 310*a* and 310*b*. The momentum trap 370 may reduce the interference from one shaped charge to the next adjacent charge such that each shaped charge maintains a high level of charge performance.

In some embodiments, momentum trap 370 may be positioned between two adjacent shaped charges such as, e.g. shaped charges 310*a* and 310*b*, such that the entirety of shaped charge 310*a* is fully isolated from the entirety of shaped charge 310*b*. Fully isolated, as used herein, means that there is no part of shaped charge 310*a* is touching or exposed to shaped charge 310*b*. In some embodiments, fully isolating shaped charge 310*a* from 310*b* may be achieved by positioning the momentum trap 370 such that the momentum trap 370 extends at least to all exterior edges of the case exterior 320 of both shaped charges 310*a* and 310*b*, and in other embodiments, the momentum trap 370 may extend beyond all exterior edges of the case exterior 320 of both shaped charges 310*a* and 310*b*.

In other embodiments, the momentum trap 370 may be positioned between shaped charges 310*a* and 310*b* such that shaped charge 310*a* is only partially isolated from shaped charge 310*b*. Partially isolated, as used herein, means that at least a part of a shaped charge (e.g., shaped charge 310*a*) is exposed to at least a part of an adjacent shaped charge (e.g., shaped charge 310*b*). For example, the momentum trap 370 may be positioned to extend radially inward from the carrier gun body to only a partial depth, less than the height of each shaped charge, such that only radially outward portions of the shaped charges 310*a* and 310*b* are isolated from each other by the momentum trap 370. Alternatively, the exposed parts of the adjacent shaped charges (e.g., shaped charges 310*a*, 310*b*) could be the radially outer parts thereof.

The momentum trap 370 may be fabricated using various materials capable of withstanding conditions experienced by tools used within a wellbore, such as a perforating gun. The liner 350 may need to penetrate, in some embodiments, at least a carrier gun body, the wellbore, a fluid casing surrounding the wellbore, cement around the fluid casing, and the subterranean formation. As such, the momentum trap 370 may comprise a high density material sufficient to withstand the explosion and force of the explosive material 360, while isolating one shaped charge 310*a* from the adjacent shaped charge 310*b*. The phrase "high density material", as used herein, means a material having a density of at least about 1.7 g/cm$^3$. Examples of a high density material which may be used include, but are not limited to, platinum, gold, tungsten, uranium, tantalum, palladium, lead, silver, molybdenum, bismuth, copper, nickel, iron, tin, zinc, zirconium, titanium, aluminum, silicon, carbon, magnesium. In another embodiment, the momentum trap 370 may comprise a "very high density material" having a density of at least about 8.9 g/cm$^3$, or in another embodiment an "extremely high density material" having a density of at least about 11.5 g/cm$^3$. The high density material, very high density material, or extremely high density material may, in certain embodiments, be solid foam, or distended foam (e.g., foams or pressed powders, at some percentage of a possible maximum density of 100%). Other embodiments may include combinations, layers, and/or alloys of the foregoing high density, very high density and extremely high density materials.

Figure 4A:
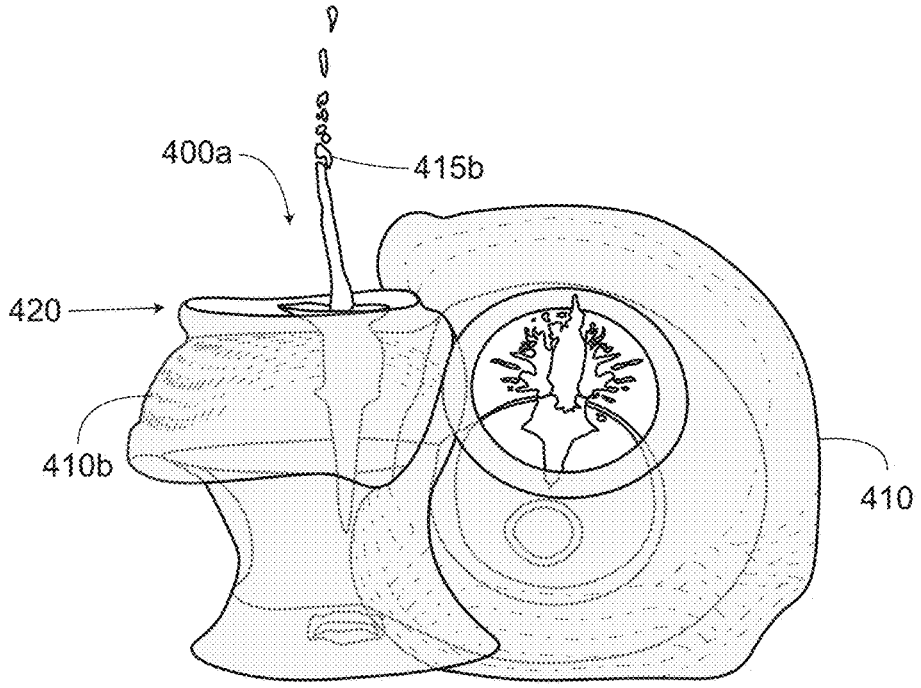
FIGS. 4A-4B illustrate how use of a momentum trap according to the disclosure impacts operation of a pair of shaped charges.
Figure 4B:
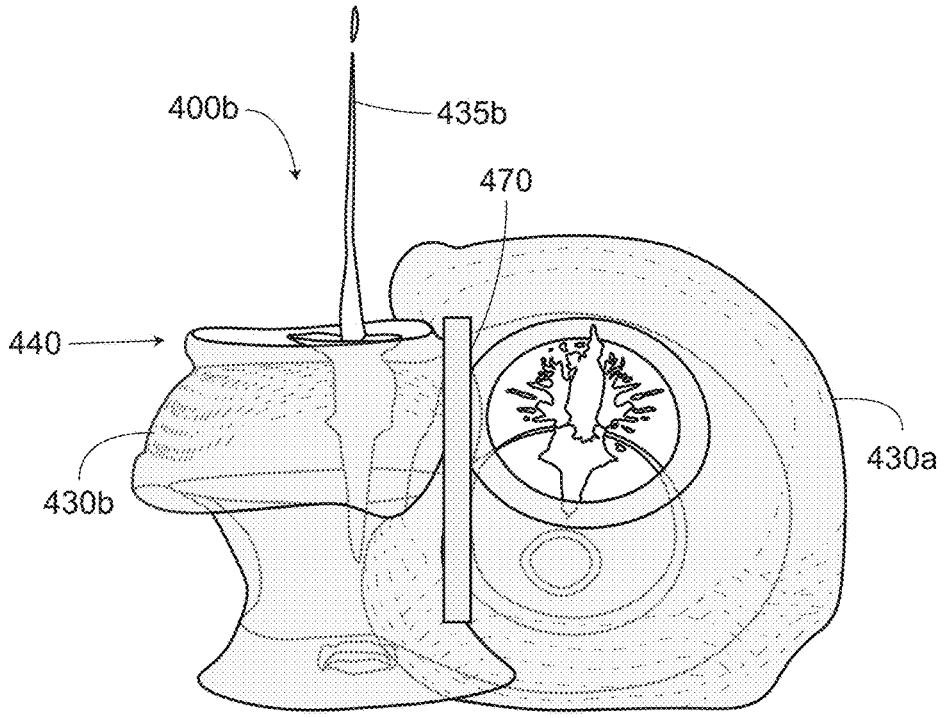

Referring now to FIGS. 4A and 4B, there are shown results from two different 2-charge perforating systems 400*a* and 400*b*, each having two adjacent shaped charges and illustrating jet streams exploding from each charge. In the perforating system 400*a* of FIG. 4A, two adjacent shaped charges 410*a* and 410*b* do not have a momentum trap between them. Shaped charge 410*a* initiates first and shaped charge 410*b* initiates after a short time delay. As shown in FIG. 4A, without any isolating mechanism between the shaped charges 410*a* and 410*b*, the performance of shaped charge 410*b* is affected. For example, a jet stream 415*b* exiting from shaped charge 410*b* is shown to deviate from the central axis of shaped charge 410*b* When the jet stream from each shaped charge is affected as shown in FIG. 4A, the charge performance of the perforating system is negatively impacted, which may result in reduced charge performance or suboptimal well performance.

FIG. 4B illustrates charge perforating system 400*b*, wherein shaped charges 430*a* and 430*b* have a momentum trap 470 positioned there between. Shaped charge 430*a* initiates first and shaped charge 430*b* initiates after a short time delay. The presence of the momentum trap 470 provides isolation of shaped charge 430*b* from shaped charge 430*a* and as a result, the jet stream 435*b* from shaped charge 430*b*, is substantially perpendicular with a top surface 440 of shaped charge 430*b*, indicating a high level of charge performance by shaped charge 430*b*. Accordingly, the charge performance of shaped charge 430*b* is only minimally impacted, if any, by shaped charge 430*a* such that shaped charge 430*b* can deliver a superior charge performance relative to the reduced charge performance illustrated in FIG. 4A.

Figure 5:
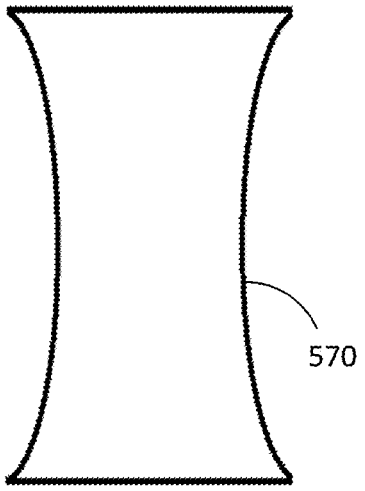
FIG. 5 illustrates one embodiment of a momentum trap according to the disclosure.

Referring now to FIG. 5, there is shown one embodiment of a momentum trap 570 which may be used between two shaped charges, such as shaped charges 310*a* and 310*b*. The momentum trap 570 may be saddle shaped and in some embodiments, be positioned between two shaped charges such that the shaped charges are fully isolated from each other.

Figure 6:
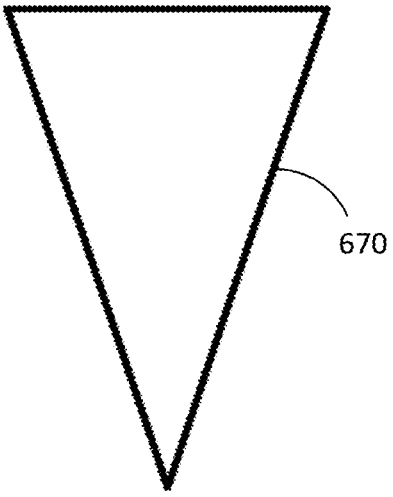
FIG. 6 illustrates another embodiment of a momentum trap according to the disclosure.

Referring now to FIG. 6, there is shown another embodiment of a momentum trap 670 which may have a triangular or wedge shape. In some embodiments, the momentum trap 670 may be positioned between two adjacent shaped charges such as to only partially isolate one shaped charge from the adjacent shaped charge. Different embodiments of momentum traps may have a variety of geometries and sizes other than shown and described herein. For examples, a momentum trap may be include but not be limited to the following shapes: a disc, wafer, plate, saddle, wedge, and other possible geometries. In some embodiments, the momentum wafer may be a symmetrical shape, but other embodiments may include momentum shapes that are not symmetric.

While the momentum traps shown in the embodiments herein have been shown substantially centered (equidistant) between the adjacent shapes charges, the momentum trap may be placed at any position between the two adjacent shaped charges and have a varying amount of spacing between the shaped charges. In one embodiment, the momentum trap may be positioned closer to a downhole shaped charge, such that there is a larger spacing between the momentum trap and an adjacent uphole shaped charge and a smaller spacing between the momentum trap and the adjacent downhole shaped charge. In other embodiments, the momentum trap may be positioned closer to the uphole shaped charge, such that there is a larger spacing between the momentum trap and an adjacent downhole shaped charge and a smaller spacing between the momentum trap and the adjacent uphole shaped charge. In some embodiments, there may be free space between the momentum trap and the adjacent shaped charges, and said free spacing may vary according to the configuration of the shaped charges and the application for which the shaped charges are configured. And in some embodiments, there may be little or no free spacing between the momentum trap and the adjacent shaped charges. In this embodiment, the momentum trap could be touching, or very close to touching, one or both of the adjacent shaped charges.

While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

Aspects disclosed herein include:

A. A perforating gun assembly for use in a wellbore, the perforating gun including: 1) a carrier gun body; and 2) a plurality of shaped charges supported within the carrier gun body, wherein each shaped charge includes a case exterior, the case exterior including an outer surface, and an inner surface forming a cavity, a liner located within the cavity, and explosive material located within a gap between the inner surface of the case exterior and the liner, and one or more momentum traps positioned between one or more adjacent shaped charges.

B. A well system, the well system including: a wellbore; and a perforating gun assembly positioned within the wellbore, the perforating gun held in place by a conveyance and comprising; 1) a carrier gun body; 2) a plurality of shaped charges supported within the carrier gun body, wherein each shaped charge includes a case exterior, the case exterior including an outer surface, and an inner surface forming a cavity, a liner located within the cavity, and explosive material located within a gap between the inner surface of the case exterior and the liner; and 3) one or more momentum traps positioned between one or more adjacent shaped charges.

C. A method for perforating a wellbore, the method including: positioning a perforating gun assembly at a desired location within a wellbore, the perforating gun assembly including; 1) a carrier gun body, 2) a plurality of shaped charges supported within the carrier gun body, wherein each shaped charge includes a case exterior, the case exterior including an outer surface, and an inner surface forming a cavity, a liner located within the cavity, and explosive material located within a gap between the inner surface of the case exterior and the liner; and 3) one or more momentum traps positioned between one or more adjacent shaped charges; and further including detonating the explosive material within the plurality of shaped charges to form a plurality of jets that penetrate the wellbore and form a plurality of openings therein.

Aspects A, B, and C may have one or more of the following additional elements in combination: Element 1: further including a charge holder disposed within the carrier gun body, the charge holder supporting the plurality of shaped charges, wherein the charge holder includes one or more openings for receiving the one or more momentum traps therein. Element 2: wherein the one or more momentum traps comprise a high-density material. Element 3: wherein the one or more momentum traps are positioned between the one or more adjacent shaped charges such that the adjacent shaped charges are fully isolated from each other. Element 4: wherein the one or more momentum traps are positioned between the one or more adjacent shaped charges such that the adjacent shaped charges are partially isolated from each other. Element 5: wherein the one or more momentum traps are positioned such that there is free space between the one or more momentum traps and the one or more adjacent shaped charges. Element 6: wherein one of the one or more momentum traps is positioned closer to one shaped charge than the adjacent shaped charge.

Those skilled in the art to which this application relates will appreciate that other and further additions, deletions, substitutions and modifications may be made to the described embodiments.

What is claimed is:

1. A perforating gun assembly for use in a wellbore, the perforating gun assembly comprising:
- a carrier gun body; and
- a plurality of shaped charges supported within the carrier gun body, wherein each shaped charge includes:
  - a case exterior, the case exterior including an outer surface, and an inner surface forming a cavity;
  - a liner located within the cavity; and
  - explosive material located within a gap between the inner surface of the case exterior and the liner; and
- one or more momentum traps positioned between one or more pairs of adjacent shaped charges at angles that are neither perpendicular to or parallel with a central axis of the carrier gun body, wherein the one or more momentum traps have a density of at least 11.5 g/cm$^3$.

2. The perforating gun assembly of claim 1, further including a charge holder disposed within the carrier gun body, the charge holder supporting the plurality of shaped charges, wherein the charge holder includes one or more openings for receiving the one or more momentum traps therein.

3. The perforating gun assembly of claim 1, wherein the one or more momentum traps are positioned between the one or more pairs of adjacent shaped charges such that the adjacent shaped charges are fully isolated from each other such that no direct linear path exists between the adjacent shaped charges.

4. The perforating gun assembly of claim 1, wherein the one or more momentum traps are positioned between the one or more pairs of adjacent shaped charges such that the adjacent shaped charges are partially isolated from each other.

5. The perforating gun assembly of claim 1, wherein the one or more momentum traps are positioned such that there is free space between the one or more momentum traps and the one or more pairs of adjacent shaped charges.

6. The perforating gun assembly of claim 5, wherein one of the one or more momentum traps is positioned closer to one shaped charge than the adjacent shaped charge.

7. The perforating gun assembly of claim 1, wherein the one or more momentum traps include platinum.

8. The perforating gun assembly of claim 1, wherein the one or more momentum traps include gold.

9. The perforating gun assembly of claim 1, wherein the one or more momentum traps include tungsten.

10. The perforating gun assembly of claim 1, wherein the one or more momentum traps include uranium.

11. The perforating gun assembly of claim 1, wherein the one or more momentum traps include tantalum.

12. The perforating gun assembly of claim 1, wherein the one or more momentum traps include palladium.

13. The perforating gun assembly of claim 1, wherein the one or more momentum traps are not physically touching the plurality of shaped charges.

14. A well system, comprising:
- a wellbore; and
- a perforating gun assembly positioned within the wellbore, the perforating gun held in place by a conveyance and comprising:
  - a carrier gun body;
  - a plurality of shaped charges supported within the carrier gun body, wherein each shaped charge includes:
    - a case exterior, the case exterior including an outer surface, and an inner surface forming a cavity;
    - a liner located within the cavity; and explosive material located within a gap between the inner surface of the case exterior and the liner; and one or more momentum traps positioned between one or more pairs of adjacent shaped charges at angles that are neither perpendicular to or parallel with a central axis of the carrier gun body, wherein the one or more momentum traps have a density of at least 11.5 g/cm$^3$.

15. The well system of claim 14, further including a charge holder disposed within the carrier gun body, the charge holder supporting the plurality of shaped charges, wherein the charge holder includes one or more openings for receiving the one or more momentum traps therein.

16. The well system of claim 14, wherein the one or more momentum traps are positioned between the one or more pairs of adjacent shaped charges such that the adjacent shaped charges are fully isolated from each other such that no direct linear path exists between the adjacent shaped charges.

17. The well system of claim 14, wherein the one or more momentum traps are positioned between the one or more pairs of adjacent shaped charges such that the adjacent shaped charges are partially isolated from each other.

18. The well system of claim 14, wherein the one or more momentum traps are positioned such that there is free space between the one or more momentum traps and the one or more pairs of adjacent shaped charges.

19. The well system of claim 18, wherein one of the one or more momentum traps is positioned closer to one shaped charge than the adjacent shaped charge.

20. A method for perforating a wellbore, comprising:

positioning a perforating gun assembly at a desired location within a wellbore, the perforating gun assembly including;

a carrier gun body; and a plurality of shaped charges supported within the carrier gun body, wherein each shaped charge includes:

a case exterior, the case exterior including an outer surface, and an inner surface forming a cavity;

a liner located within the cavity; and explosive material located within a gap between the inner surface of the case exterior and the liner; and one or more momentum traps positioned between one or more pairs of adjacent shaped charges at angles that are neither perpendicular to or parallel with a central axis of the carrier gun body, wherein the one or more momentum traps have a density of at least 11.5 g/cm$^3$;

detonating the explosive material within the plurality of shaped charges to form a plurality of jets that penetrate the wellbore and form a plurality of openings therein.

21. The method for perforating a wellbore of claim 20, further including a charge holder disposed within the carrier gun body, the charge holder supporting the plurality of shaped charges, wherein the charge holder includes one or more openings for receiving the one or more momentum traps therein.

22. The method for perforating a wellbore of claim 20, wherein the one or more momentum traps are positioned between the one or more pairs of adjacent shaped charges such that the adjacent shaped charges are fully isolated from each other such that no direct linear path exists between the adjacent shaped charges.

23. The method for perforating a wellbore of claim 20, wherein the one or more momentum traps are positioned between the one or more pairs of adjacent shaped charges such that the adjacent shaped charges are partially isolated from each other.

24. The method for perforating a wellbore of claim 20, wherein the one or more momentum traps are positioned such that there is free space between the one or more momentum traps and the one or more pairs of adjacent shaped charges.

25. The method for perforating a wellbore of claim 24, wherein one of the one or more momentum traps is positioned closer to one shaped charge than the adjacent shaped charge.

* * * * *